US006765535B1

(12) United States Patent
Brown et al.

(10) Patent No.: US 6,765,535 B1
(45) Date of Patent: Jul. 20, 2004

(54) MONOLITHIC MILLIMETER WAVE REFLECT ARRAY SYSTEM

(75) Inventors: Kenneth W. Brown, Yucaipa, CA (US); James R. Gallivan, Pomona, CA (US)

(73) Assignee: Raytheon Company, Waltham, MA (US)

( * ) Notice: Subject to any disclaimer, the term of this patent is extended or adjusted under 35 U.S.C. 154(b) by 96 days.

(21) Appl. No.: 10/153,140

(22) Filed: May 20, 2002

(51) Int. Cl.[7] ..... H01Q 1/38
(52) U.S. Cl. ..... 343/700 MS; 343/754
(58) Field of Search ..... 343/700 MS, 795, 343/754, 909, 912, 850, 853

(56) References Cited

U.S. PATENT DOCUMENTS

| | | | | |
|---|---|---|---|---|
| 5,333,000 A | | 7/1994 | Hietala et al. | |
| 5,381,157 A | * | 1/1995 | Shiga | 343/700 MS |
| 5,386,215 A | * | 1/1995 | Brown | 343/795 |
| 6,020,853 A | * | 2/2000 | Richards et al. | 343/700 MS |
| 6,137,377 A | | 10/2000 | Wallace et al. | |

FOREIGN PATENT DOCUMENTS

| | | | |
|---|---|---|---|
| EP | 0 509 214 A2 | 10/1992 | H01Q/23/00 |
| EP | 1 120 856 A1 | 8/2001 | H01Q/3/46 |

* cited by examiner

*Primary Examiner*—Hoang V. Nguyen
(74) *Attorney, Agent, or Firm*—William J. Benman, Jr.; Thomas J. Finn; Glenn H. Lenzen, Jr.

(57) ABSTRACT

A monolithic semiconductor power device. The device is designed to produce high energy density and high power level RF/Millimeter wave radiation using the quasi-optical spatial power of an array (100) of small amplifiers (200) on a solid state wafer (300). Each cell (200) of the array (100) contains a reflection amplifier (206) that receives radiation and retransmits the signal back into the approximate same direction from which it was received. The radiation exiting from the array (100) is physically like a reflection that has been modified by the individual amplifier's characteristics. The exiting amplified radiation leaves the array (100) as a coherent wave front (110). The individual amplifier elements are fabricated on a monolithic solid state wafer (300). Rather than being diced into individual amplifiers, the elements are electrically connected together with proper biases and ground levels on the actual solid state wafer.

5 Claims, 4 Drawing Sheets

MONOLITHIC MILLIMETER WAVE REFLECT ARRAY SYSTEM

BACKGROUND OF THE INVENTION

1. Field of the Invention

This invention relates to power devices. Specifically, the present invention relates to semiconductor power devices.

2. Description of the Related Art

Techniques have been developed for producing W-band semiconductor power devices (e.g. 50 Ghz to 120 Ghz). For example Gunn and Impatt diode sources have been developed which produce ¼ watt of power. However, these sources are very expensive. Indium Phosphide High Electron Mobility Transistor (InP HEMT) amplifiers have been developed which produce 1/10 watt of power. However these devices range from $10,000 to $20,000 in cost. Lastly, technologies are being developed which produce heat with high-frequency microwave beams. These technologies require power in the 100 KW to 1 MV range. However, devices implemented with these technologies (tubes) may cost millions of dollars each.

In general, devices implemented with conventional technologies do not generate affordable power in the W-band. In addition, the flexibility of conventional power systems, such as Gunn and Impatt diodes and InP HEMT amplifiers, is limited.

Thus, there is a need in the art for a cost effective high power W-band power system. That is, there is a need in the art for a W-band power system that can be inexpensively configured, to provide variable output power levels. Lastly, there is a need for a W-band power system that takes advantage of current semiconductor manufacturing technology to minimize costs.

SUMMARY OF THE INVENTION

The need in the art is addressed by the reflector of the present invention. Generally, the inventive reflector includes a monolithic semiconductor substrate and a mechanism disposed on the substrate for coherently reflecting electromagnetic energy.

In the illustrative embodiment, the mechanism is a monolithic array of cells with each cell including transmit and receive antenna and an amplifier therebetween. In the best mode, the antenna is a dual polarization antenna. That is, the receive antenna receives incident electromagnetic energy with a first polarization. This energy is amplified and provided to the second antenna, which retransmits the energy at an orthogonal polarization. The combined output of the cells is a coherent electromagnetic wavefront.

DESCRIPTION OF THE INVENTION

While the present invention is described herein with reference to illustrative embodiments for particular applications it should be understood that the invention is not limited thereto. Those having ordinary skill in the art and access to the teachings provided herein will recognize additional modifications, applications, and embodiments within the scope thereof and additional fields in which the present invention would be of significant utility.

The present invention is designed to produce high energy density and high power level RF/Millimeter wave radiation using the quasi-optical spatial power of an array of small amplifiers on a solid state wafer. Each cell of the array contains a reflection amplifier that receives radiation and retransmits the amplified signal back into the approximate same direction from which it was received. The radiation exiting from the array is physically like a reflection that has been modified by the individual amplifier's characteristics. The exiting amplified radiation leaves the array as a coherent wave front.

The individual amplifier elements are fabricated on a monolithic solid state wafer. Rather than being diced into individual amplifiers, the elements are electrically connected together with proper biases and ground levels on the actual solid state wafer or a sub-set of the wafer. This allows an entire array to be fabricated and electrically biased on a typical 3 to 4 inch diameter solid state wafer. When working in the W-Band Millimeter Wave region this could allow on the order of a thousand amplifiers per wafer. Because each solid state amplifier is limited to in the order of 100 mW, the wafer power output would be in the order of 100 watts.

From antenna theory, the array elements need to be small with respect to the wavelength. The amplifiers are built to be 0.5 to 1.0 wavelengths or less in side dimension on the individual array elements. The array element includes antennas of two polarizations, bias and ground wiring and amplifiers. All the elements are fabricated on the solid state wafer.

In the illustrative embodiment, the incident radiation is polarized and the exiting radiation is shifted to an orthogonal polarization. Two patch antennas are used per amplifier. The incident antenna has the same polarization as the incoming radiation to the array and the exiting radiation is in the orthogonal plane relative to the transmit antenna.

Figure 1:
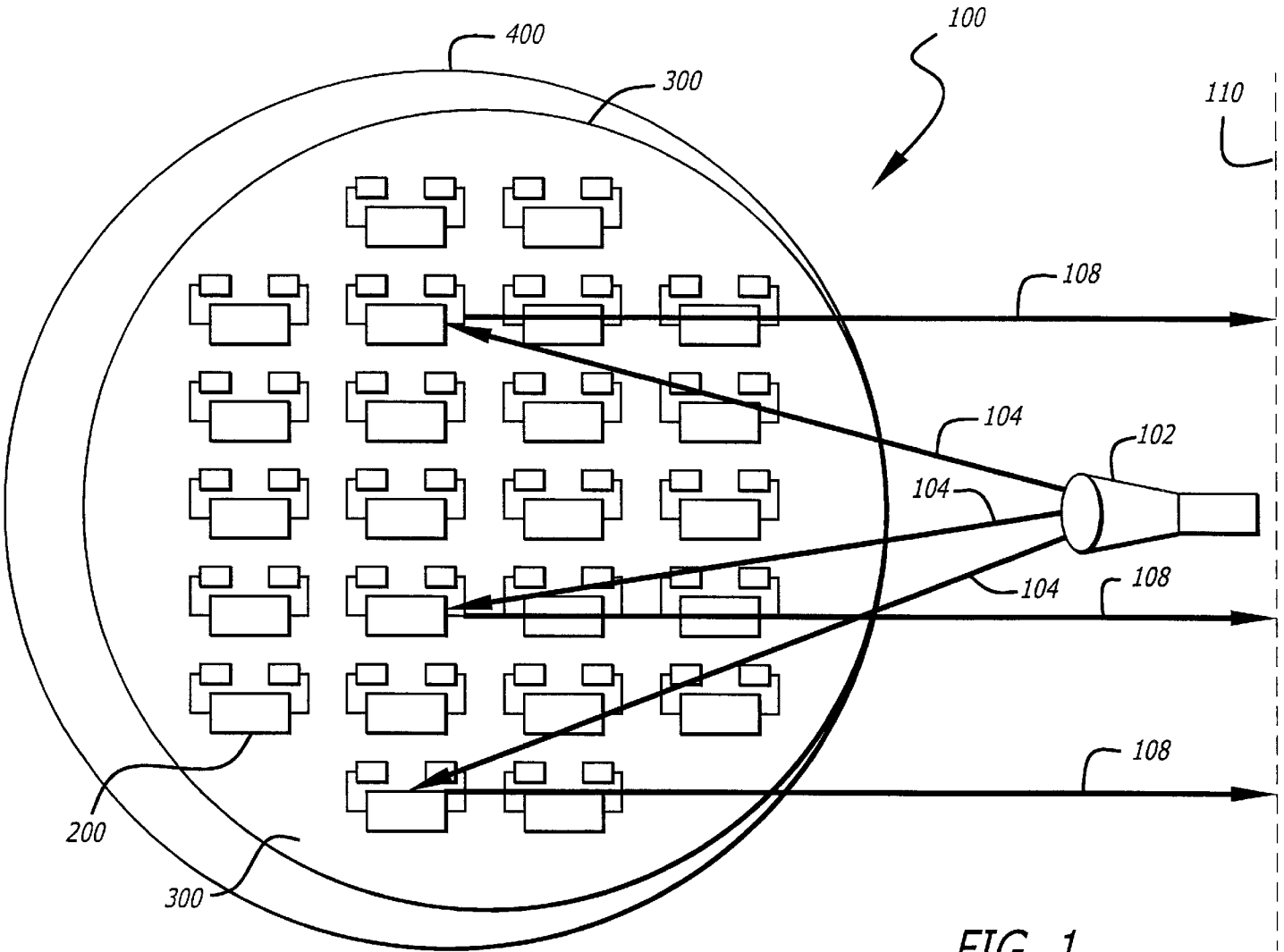
FIG. 1 is a schematic diagram of a monolithic, millimeter-wave, active reflect array implemented in accordance with the teachings of the present invention.

FIG. 1 is a schematic diagram of a monolithic, millimeter-wave, active reflect array implemented in accordance with the teachings of the present invention. The array 100 is fed by a conventional low power source 102, which generates incident energy 104 in the W-band. The array 100 includes a plurality of cells 200 disposed on a monolithic substrate 300. In the illustrative embodiment, the monolithic semiconductor substrate 300 is Indium Phosphide (InP). The monolithic semiconductor substrate 300 is in contact with a cold plate 400 for cooling.

Figure 2:
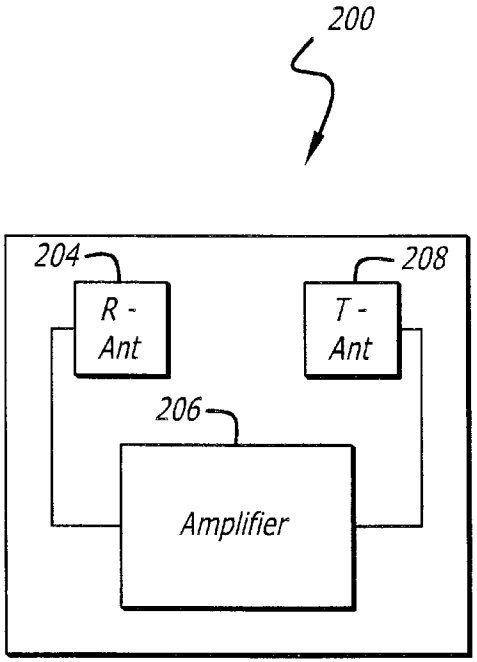
FIG. 2 displays a high-level block diagram of an individual cell of the array of cells of FIG. 1.

FIG. 2 displays a high-level block diagram of an individual cell 200 of the array of cells 100 of FIG. 1. In the preferred embodiment of the present invention, each cell 200 is designed to be small with respect to the wavelength of incident energy directed at the monolithic semiconductor substrate 300. Thus, in the illustrative embodiment, each cell 200 is designed to be 0.5 to 1.0 wavelengths or less in width and height dimensions. Those skilled in the art will appreciate that the present invention is not limited to the dimensions of the cells.

As illustrated in FIG. 2, each cell 200 includes a receive patch antenna 204 for receiving incident energy, an amplifier 206 and a transmit antenna 208. The cells 200 are arranged to receive the incident energy 104. The received energy is amplified by the amplifier 206 and retransmitted via the transmit patch antenna 208. The array of cells 106, reflect the incident energy 104 and produce reflected energy 108. In the best mode, the incident energy received by the receive patch antenna 204 has a first polarization relative to the receive antenna 204 and the reflected energy generated by the transmit patch antenna 208 has a second polarization relative to the transmit antenna 208 orthogonal to the first polarization. The reflected energy 108 is reflected in a coherent manner and therefore forms a high power wave front 110 (see FIG. 1). Those skilled in the art will appreciate that the present invention is not limited to the use of patch antennas.

In the best mode, the array 100 is optimized for high output power for a given size, high-efficiency and low cost. A noteworthy aspect of the invention is the practical matter in which thousands of low power millimeter amplifiers can be used to produce a high power energy level.

Returning to FIG. 1, to maximize the power output and power density, the power of each element must be maximized. This is accomplished by directly attaching the wafer 300 to the cooling plate 400 to remove heat and reduce the temperature of the individual amplifiers to a reliable level for the given output. Ideally, the wafers are attached directly to the cold plate with very thin bonding material only so that the cooling heat of the elements is maximized. The interconnect wiring should be efficiently cooled. The cold plate 400 can take several forms such as a heat sink, a thermoelectric cooler or a liquid cooled plate depending on the dynamics of the amplifiers duty cycle without departing from the scope of the present teachings.

Figure 3:
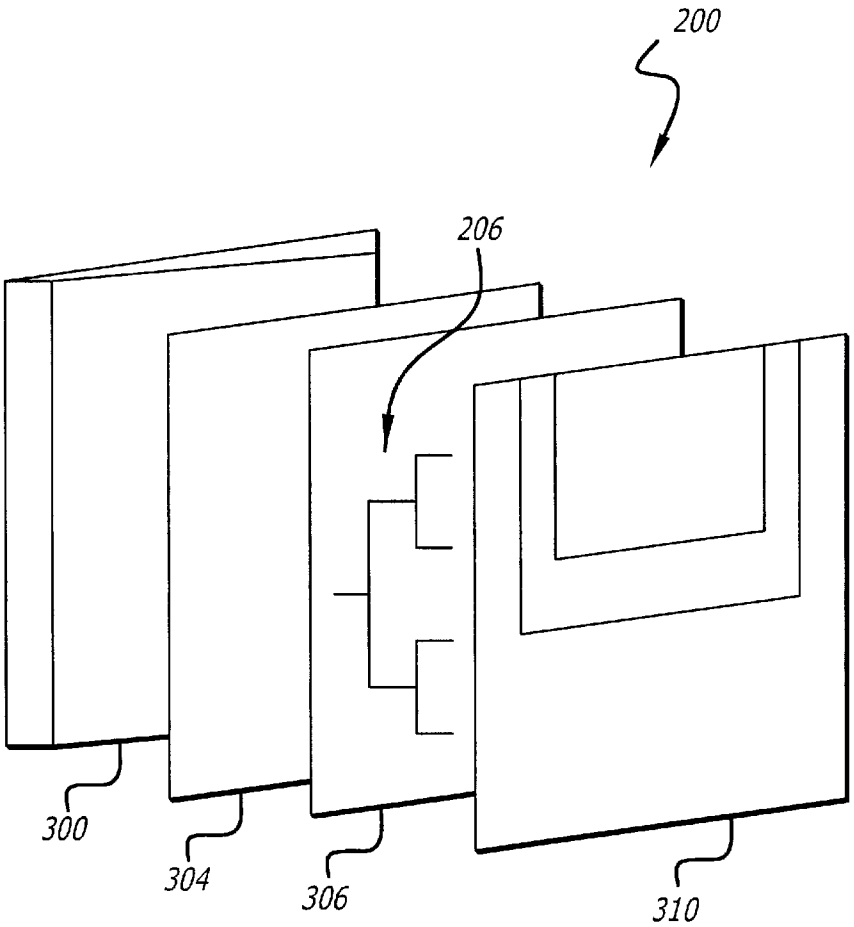
FIG. 3 magnified, fragmentary exploded view of a single cell of the array of FIG. 1.

FIG. 3 is a magnified, fragmentary exploded view of a single cell of the array of FIG. 1. In general, in the best mode, very thin layers of a solid state substrate are made using materials of as high a thermal conduction as possible. A deposited and etched layer is then added providing all the electrical interconnects, components, amplifiers, and grounding planes. As discussed more fully below, the dual polarization antenna structures are disposed in uppermost layers.

In accordance with an illustrative embodiment of the teachings of the present invention, a monolithic InP substrate 300 is formed in a conventional manner. A first metal layer 304 is then applied to the substrate using conventional fabrication techniques. The first metal layer 304 serves as a DC supply line for the cell 200. A first layer of oxide (not shown) is applied to the first metal layer as an intermediate layer in forming the cell. A second metal layer 306 is then applied. The second metal layer 306 serves as the DC ground of the cell and includes amplifier circuits 206. In addition, the second metal layer 306 serves as an intermediate layer for vias connecting upper layers to the lower metal layer 304 and the substrate 302. A second layer of oxide is applied as a second intermediate layer in forming the cell. Lastly, patch antennas are formed in a third metal layer 310.

In the illustrative embodiment, a monolithic Indium Phosphide (InP) semiconductor substrate is used. An epitaxy layer is formed on the substrate to reduce crystalline or contaminate defects. In the illustrative embodiment of the present invention, the substrate dimensions are approximately 4 inches by 4 inches.

The pattern of the amplifier circuit and the antenna circuit included in a cell, are implemented in the substrate with a mask. Each layer of the semiconductor device is developed using a specific mask. The mask contains the amplifier circuit design and the antenna circuit design elements. Both the amplifier circuit design and the antenna circuit design are formed using pattern generation equipment (e.g. computer graphic circuit design equipment), which is driven by a circuit design database. The mask starts as a design schematic and is then transformed into a layout for implementation in the InP substrate. The finished mask product is referred to as a recticle. The InP substrate is coated with a photoresist material. In a photolithography process, the mask containing the amplifier and antenna design is exposed by a light source, through a lens system, onto the substrate. The mask is then stepped over to the next area of the substrate and the process is repeated until the substrate is completely exposed (e.g. this is often called a step and repeat process).

In the illustrative embodiment, the entire wafer (e.g. 4 inches×4 inches), or a large sub-section of the wafer (e.g. 0.5" to 0.5"), other wafer fabrication techniques, such as electron beam lithography can also be utilized. While the invention is not limited to any particular fabrication technique, two methods are described here. In a first method, the input and output feeds of a specific circuit are designed such that the output for one mask, physically aligns with the input for a second mask. As a result, after the step and repeat process, the input and output for each circuit on the substrate align and create a single unified circuit that covers the entire substrate.

In a second method, a mask is implemented with a dual mask set. A larger mask including required power and output connections is etched into the entire substrate. The larger mask is implemented at the proper level in the InP device to facilitate power conduction (e.g. a power line mask). A second, smaller integrated circuit mask, is then used to etch the integrated circuits into the substrate. The second mask is a high resolution mask and is designed so that the integrated circuits from the second mask align with the power line connections etched into the substrate from the first mask.

In addition to the two methods for etching the designs into the substrate, the mask are designed and the stepper function is performed, so that as many cells as possible are placed in series. This allows higher voltages and lower currents to be used. As a result the final circuit has lower resistive loss, smaller metallic line widths and lower heat generation. An etch process (wet or dry) is used to remove oxide where the photoresist pattern is absent. The photoresist is then stripped off the substrate, leaving the oxide pattern on the substrate. The substrate is then exposed to high temperature to grow an oxide layer.

The oxide acts as a barrier when dopant chemicals are deposited on the surface and diffused into the surface. Alternatively, dopants may be bombarded into the InP surface. The induced ions create regions with different properties. These regions become the source and drain of transistors. A deposition process is performed in which, an opening is made in the oxide to build the transistor's gate region. A thin gate oxide or silicon nitride is deposited through a Chemical Vapor Deposition (CVD) process to act as an insulator between the gate and the InP. This is followed by Physical Vapor Deposition (PVD) or "sputtering" of a conductive polysilicon layer to form the transistor's gate.

An oxidation process is performed in which various oxides are grown or deposited to insulate or protect the formed transistors. Deep Field Oxides are grown to isolate each transistor from its adjacent partners. Dielectric isolation oxides are deposited to insulate the transistors from interconnecting layers. Passivation oxides are later deposited on top of completed substrate to protect the surface from damage.

Interconnections are made using the photolithography process mentioned above. Contact holes (e.g. vias) are etched down to the transistor regions to establish circuit connections. Metallization is then performed. A layer of a metallic substance such as aluminum is deposited on the surface and down into the via holes. Excess aluminum is etched away after another photolithography process, leaving the desired interconnect pattern. Another layer of dielectric isolation oxide is deposited to insulate the first layer of aluminum from the next. Each step produces surface contours. The surface of the wafer is polished smooth using techniques such as Chemical Mechanical Planarization. The smooth surfaces maintain photolithographic depth of focus for subsequent steps and also ensure that aluminum interconnects don't deform.

Layers are then interconnected. Another set of the via holes are etched in the dielectric isolation oxide to enable access down to the layer below. Contact plugs are deposited (often tungsten) into the vias to reach down and make contact to the lower layer. The next layer of aluminum is deposited, patterned and etched. This process is repeated for as many interconnect layers as a required for the design. In the present invention, this repeated process forms a cell by matching and managing the shielding and dielectric properties of the metal and oxide layers.

Figure 4:
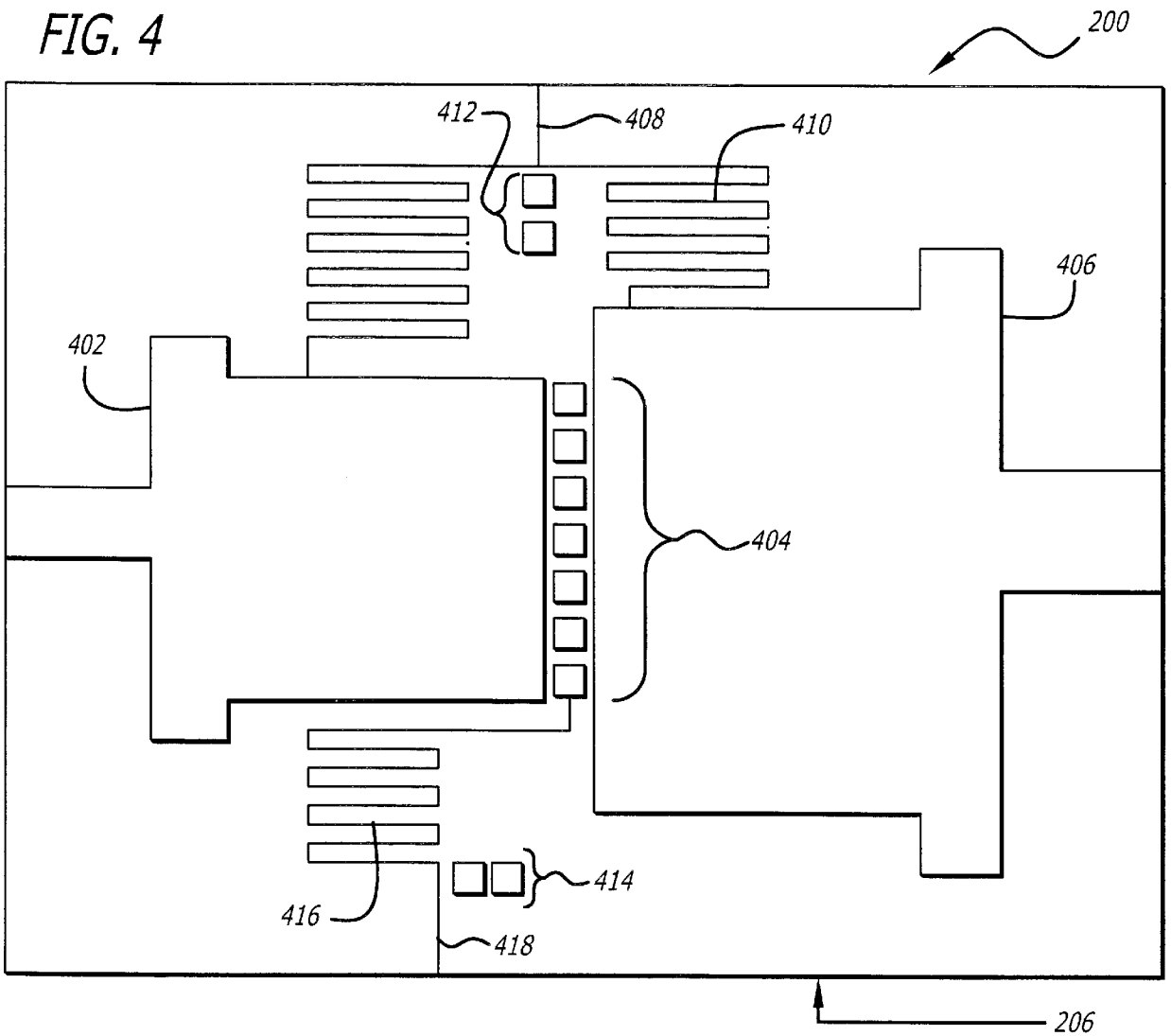
FIG. 4 displays a W-band semiconductor layout of an individual cell of the array of the present invention.

FIG. 4 displays a W-band semiconductor layout of an individual cell 200 of the array of the present invention. In FIG. 4, the amplifier 206 includes an RF matching network. The RF matching network includes an input matching circuit 402, a transistor/capacitor network 404 and an output matching circuit 406. Direct current (DC) power is fed into the network through a DC supply 408. A first isolation inductor 410, isolates DC power from the RF matching network. A capacitor connected to a ground plane is shown as 412. A DC ground is shown as 418. A second isolation inductor 416, isolates the RF matching network from ground. A second capacitor is shown as 414. The capacitors, 404, 412 and 414, isolate the DC power from the RF power and also isolate the RF input matching network from the RF output matching network.

Figure 5:
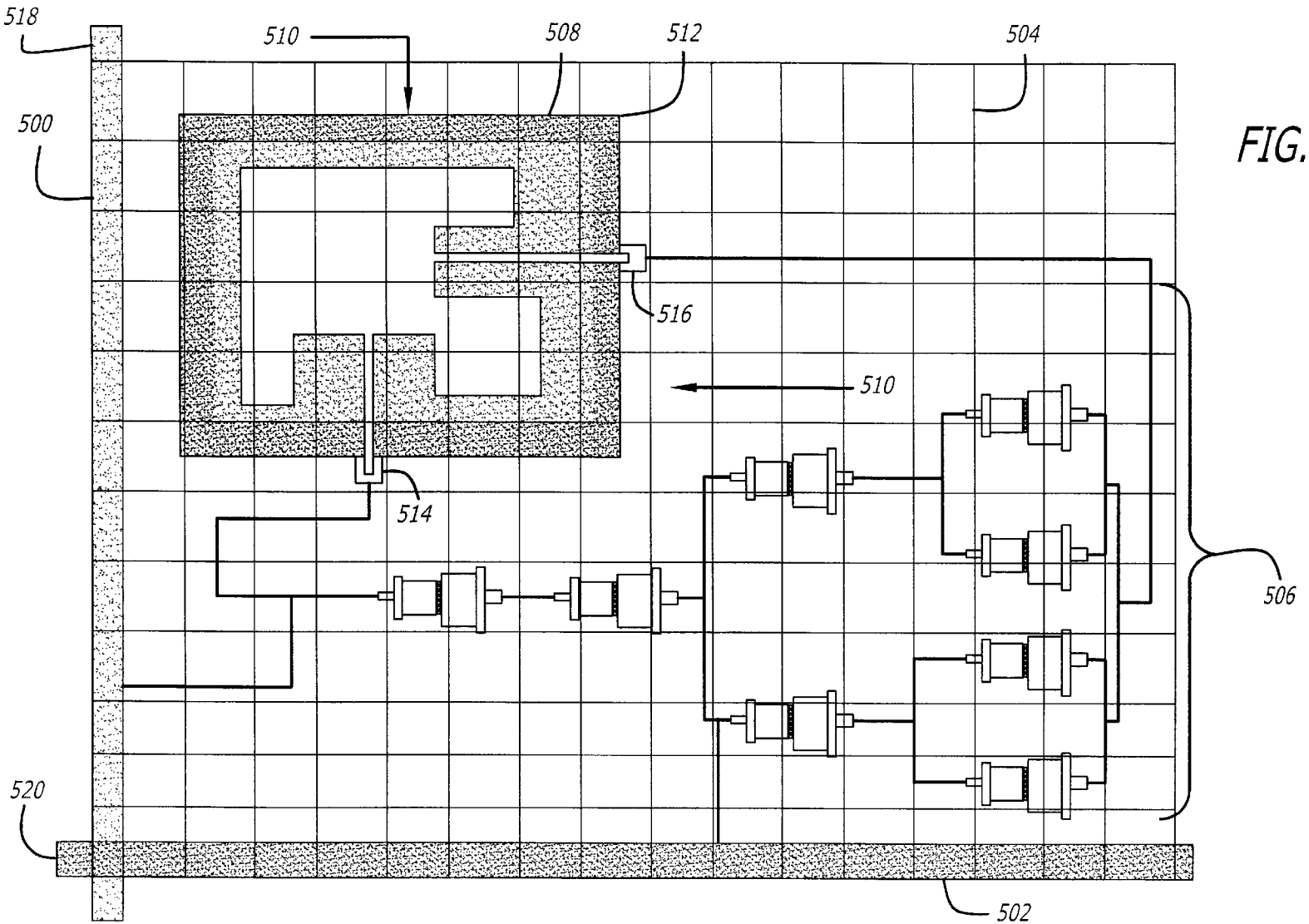
FIG. 5 shows a multistage amplifier with a patch antenna for the array of FIG. 1 in accordance with the teachings of the present invention.

FIG. 5 shows a multistage amplifier with a patch antenna for the array of FIG. 1 in accordance with the teachings of the present invention. In FIG. 5 a first metal layer is shown as 500. The first metal layer 500 serves as the DC supply line for the monolithic semiconductor device. An amplifier network 506 is implemented in the first metal layer 500. A second metal layer 502 is shown. The second metal layer 502, serves as the DC ground for the monolithic semiconductor device. A third metal layer 504 is also shown. A patch antenna 510 is implemented in the third metal layer. The patch antenna 510 may be implemented with a corrugated wideband patch or a two layer corrugated wideband patch. A plurality of vias 512 establishes DC connection between the first metal layer 500, the second metal layer 502 and the third metal layer 504. An input to the patch antenna is shown as 514 and an output from the patch antenna is shown as 516. The amplifier network 506 is designed in series with respect to the DC power and in parallel with respect to RF signals. It should be noted that both the DC supply (e.g. first metal layer 500) and the DC ground (e.g. second metal layer 502) extend beyond the third metal layer 504, so that when the individual cells are combined to form an array, a single circuit will be established between the cells.

In each individual cell 200, the first metal layer 500 includes an overlapping portion 518. The overlapping portion 518 is implemented to provide a single DC supply to each cell in the array of cells. A second overlapping portion is shown as 520. The second metal layer 502 includes the second overlapping portion 520 and is implemented to provide a single DC ground to each cell in the array of cells. As a result, each cell in the array of cells combines to form a single circuit with a single DC supply and a single DC ground.

The energy does not have to be radiated into space but can be used in an in-line amplifier configuration.

Those skilled in the art will also appreciate that the array of amplifier elements can be assembled with respect to an array size optimized for fabrication. The array elements can then be tiled onto a cooling plate until enough elements exist to produce needed output power levels.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A monolithic millimeter wave reflector array system comprising:

a monolithic semiconductor substrate and means disposed on said substrate for coherently reflecting electromagnetic energy, said means including an array of cells, each of said cells including an antenna for receiving said electromagnetic energy, an amplifier connected to said receive antenna, and an output antenna.

2. The invention of claim 1 wherein the output of each of said amplifiers constitutes said coherently reflecting electromagnetic energy.

3. The invention of claim 1 wherein each of said cells includes a dual polarization antenna structure.

4. The invention of claim 3 wherein said antenna structure is a patch antenna.

5. The invention of claim 4 wherein said antenna structure is a corrugated patch antenna.

* * * * *